US010992043B2

(12) United States Patent
Huang et al.

(10) Patent No.: US 10,992,043 B2
(45) Date of Patent: Apr. 27, 2021

(54) ANTENNA DEVICE AND CONTROL METHOD THEREOF

(71) Applicant: ASUSTeK COMPUTER INC., Taipei (TW)

(72) Inventors: Pei-Chuan Huang, Taipei (TW); Shao-Kai Liu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/510,073

(22) Filed: Jul. 12, 2019

(65) Prior Publication Data

US 2020/0028265 A1 Jan. 23, 2020

(30) Foreign Application Priority Data

Jul. 19, 2018 (CN) ..... 201810794869.6

(51) Int. Cl.

| | |
|---|---|
| ***H01Q 1/24*** | (2006.01) |
| ***H01Q 9/04*** | (2006.01) |
| ***H01Q 1/36*** | (2006.01) |
| ***H01Q 19/00*** | (2006.01) |
| ***H01Q 1/50*** | (2006.01) |

(52) U.S. Cl.

CPC ..... *H01Q 9/045* (2013.01); *H01Q 1/24* (2013.01); *H01Q 1/243* (2013.01); *H01Q 1/36* (2013.01); *H01Q 1/50* (2013.01); *H01Q 19/005* (2013.01)

(58) Field of Classification Search

CPC ..... H01Q 1/243; H01Q 21/30; H01Q 5/371; H01Q 5/335; H01Q 21/28; H01Q 5/321;

(Continued)

(56) References Cited

U.S. PATENT DOCUMENTS 6,757,267 B1 * 6/2004 Evans ..... H04B 7/0615 342/374
8,022,881 B2 * 9/2011 Wong ..... H01Q 5/00 343/700 MS (Continued)

FOREIGN PATENT DOCUMENTS

CN 102790638 A 11/2012
CN 104425873 A 3/2015

(Continued)

OTHER PUBLICATIONS

Wong Kang et al., "A Beam Pattern-Reconfigurable antenna Using PIN diodes"; 2010 IEEE Antennas and Propagation Society International Symposium, Sep. 2, 2010.

*Primary Examiner* — Vibol Tan
(74) *Attorney, Agent, or Firm* — McClure, Qualey & Rodack, LLP

(57) ABSTRACT

An antenna device and its control method is provided. The antenna device includes: a ground layer; a feeding element, connecting to the ground layer; a first radiating element, extending along a first direction and connected to the ground layer; a second radiating element, extending along a second direction which is orthogonal to the first direction, and connected the ground layer; a first switching element, coupled between the feeding element and the first radiating element, and configured to electrically connect or disconnect the feeding element and the first radiating element; and a second switching element disposed between the feeding element and the second radiating element, and configured to electrically connect or disconnect the feeding element and the second radiating element.

16 Claims, 10 Drawing Sheets

(58) Field of Classification Search
CPC ..... H01Q 13/10; H01Q 1/24; H01Q 1/36; H01Q 21/29; H01Q 3/247; H01Q 5/328; H01Q 9/26; H01Q 19/005; H01Q 1/2291; H01Q 1/241; H01Q 1/242; H01Q 1/246; H01Q 1/50; H01Q 25/00; H01Q 5/00; H01Q 5/10; H01Q 5/357; H01Q 5/364; H01Q 5/50
See application file for complete search history.

(56) References Cited

U.S. PATENT DOCUMENTS

| | | | | |
|---|---|---|---|---|
| 8,698,673 | B2 * | 4/2014 | Wong | H01Q 9/42 343/700 MS |
| 9,166,667 | B2 * | 10/2015 | Thanikachalam | H04B 7/0691 |
| 9,559,422 | B2 * | 1/2017 | Wong | H01Q 21/30 |
| 9,799,963 | B2 * | 10/2017 | Huang | H01Q 21/062 |
| 2008/0122717 | A1 | 5/2008 | Su et al. | |
| 2010/0214189 | A1 | 8/2010 | Kanazawa | |
| 2017/0062946 | A1 * | 3/2017 | Cole | H01Q 3/14 |
| 2018/0026353 | A1 * | 1/2018 | Tseng | H01Q 13/10 455/575.7 |
| 2020/0067539 | A1 * | 2/2020 | Park | H01Q 9/42 |

FOREIGN PATENT DOCUMENTS

| | | | |
|---|---|---|---|
| CN | 105577223 | A | 5/2016 |
| CN | 107359402 | A | 11/2017 |
| TW | 200822438 | A | 5/2008 |
| WO | 2012159517 | A1 | 11/2012 |

* cited by examiner

ANTENNA DEVICE AND CONTROL METHOD THEREOF

CROSS-REFERENCE TO RELATED APPLICATION

This application claims the priority benefit of Chinese application serial No. 201810794869.6, filed on Jul. 19, 2018. The entirety of the above-mentioned patent application is hereby incorporated by reference herein and made a part of specification.

BACKGROUND OF THE INVENTION

Field of the Invention

The invention relates to an antenna device and, more particularly, to a control method of the antenna device.

Description of the Related Art

In recent years, with the rapid development of communication technology, wireless communication devices have become an indispensable communication medium for people. In addition, wireless communication standards and communication bands used in different places are different. Therefore, the antennas in the wireless communication devices must be able to receive or transmit radio signals in multiple frequency bands, so that the wireless communication device can support various communication standard.

However, the wireless communication devices are designed in thin and small dimension, and the space for configuring antennas is limited, which affects the communication performance of antenna.

BRIEF SUMMARY OF THE INVENTION

According to a first aspect of the disclosure, an antenna device is provided herein. The antenna device comprises: a ground layer; a feeding element, connecting to the ground layer; a first radiating element, extending along a first direction and connected to the ground layer; a second radiating element, extending along a second direction which is orthogonal to the first direction, and connected the ground layer; a first switching element, coupled between the feeding element and the first radiating element, and configured to electrically connect or disconnect the feeding element and the first radiating element; and a second switching element disposed between the feeding element and the second radiating element, and configured to electrically connect or disconnect the feeding element and the second radiating element.

According to a second aspect of the disclosure, a control method of an antenna device is provided herein. The antenna device in the control method includes a feeding element, a first radiating element, and a second radiating element. The feeding element is coupled between the first radiating element and the second radiating element. The control method of the antenna device comprises: obtaining a first receiving signal strength indication of the antenna device in a first operating state, wherein the feeding element is connected with the first radiating element and disconnected from the second radiating element in the first operating state; obtaining a second receiving signal strength indication of the antenna device in a second operating state, wherein the feeding element is disconnected from the first radiating element and is connected with the second radiating element in the second operating state; and comparing the first receiving signal strength indication with the second receiving signal strength indication, wherein the antenna device operates in the first operating state when the first receiving signal strength indication is greater than the second receiving signal strength indication, and the antenna device operates in the second operating state when the first receiving signal strength indication is not greater than the second receiving signal strength indication.

Under the foregoing structural configuration, the disclosure provides at least two antennas with different structures and the same feed element. In addition, the first switching element and the second switching element are controlled by the control unit. At the same time, different resonance modes at the same frequency are generated by utilizing the cooperation among the signal source, the first switching element and the second switching element 18, and different radiation patterns are further obtained. In the embodiment, the different radiation patterns generated jointly complement the radiation zero of the XY plane with each other. That is, in the antenna device, different radiation patterns complement each other to solve the problem that the radiation intensity of the antenna device is weak in particular orientations by the resonance modes different from each other, thereby avoiding the zero point of the radiation patterns of the antenna device.

Therefore, the antenna device of the disclosure switches the switching element to select the radiating elements at different positions according to the environment where the antenna device is located, to solve the pattern defects caused by the single radiation member, and to enhance the radiation intensity of the radiation patterns in particular orientations. Therefore, the weak radiation intensity of the antenna device in specific orientations is avoided, thereby improving the transmission performance of the antenna device and its practicability on the product, and avoiding problems such as disconnection.

These and other features, aspects and advantages of the disclosure will become better understood with regard to the following description, appended claims, and accompanying drawings.

DETAILED DESCRIPTION OF THE EMBODIMENTS

Figure 1:
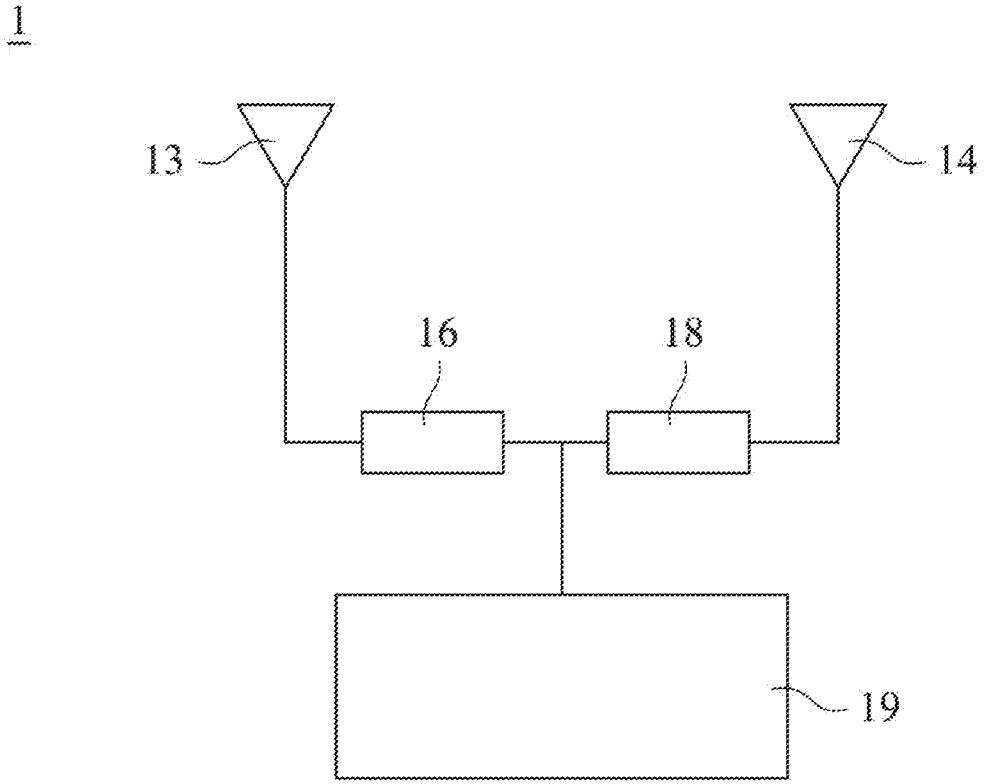
FIG. 1 is an architectural diagram of an antenna device in accordance with an embodiment of the disclosure.

Please refer to FIG. 1. FIG. 1 is an architectural diagram of an antenna device according to an embodiment of the disclosure. As shown in FIG. 1, the architecture of the antenna device 1 of the embodiment includes a first radiating element 13, a second radiating element 14, a first switching element 16, a second switching element 18, and a control unit 19. In the present embodiment, the first switching element 16 is connected in series with the first radiating element 13, and the second switching element 18 is connected in series with the second radiating element 14. The first switching element 16 and the second switching element 18 are connected in parallel and are simultaneously controlled by the control unit 19.

Figure 2A:
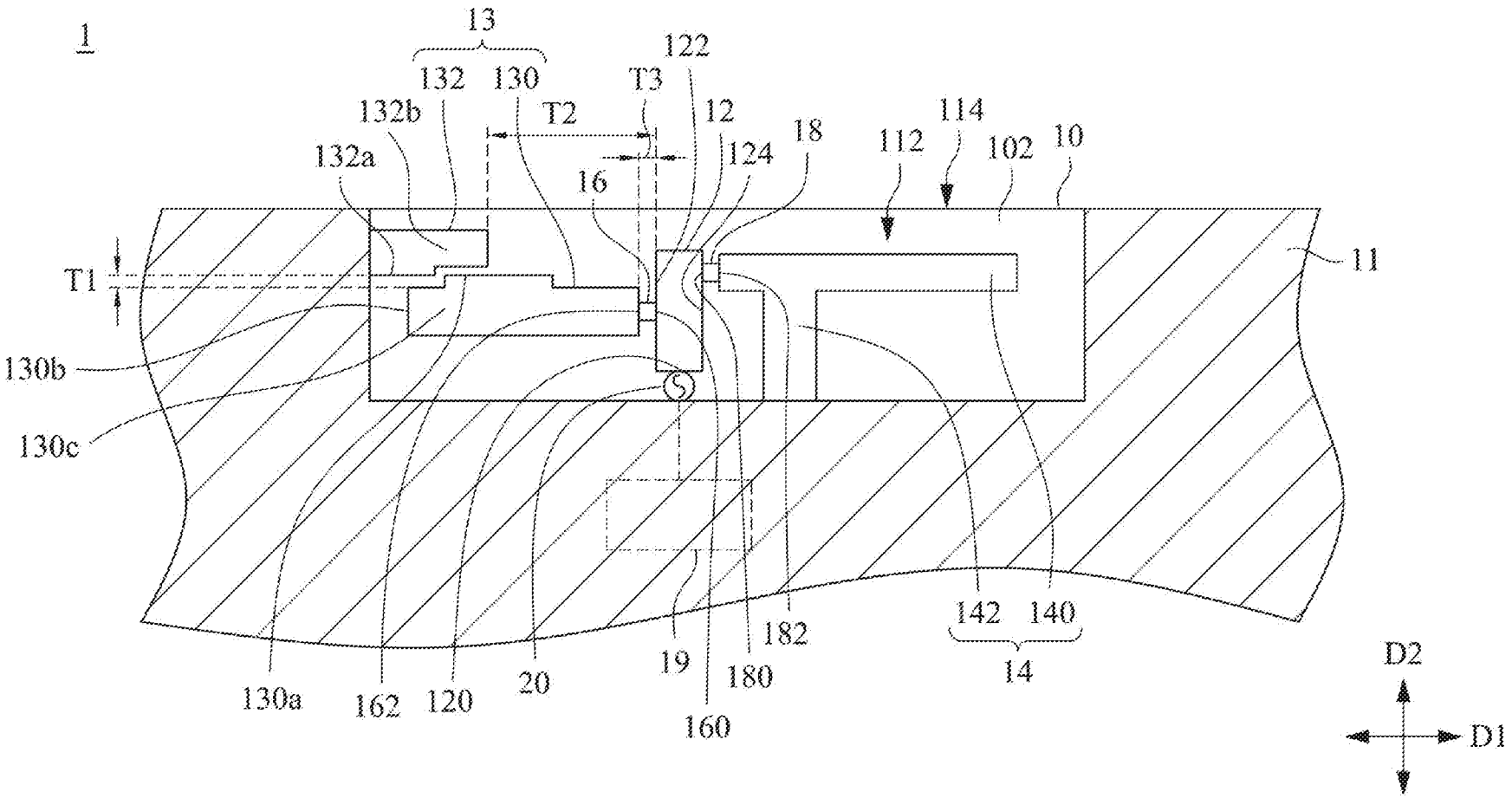
FIG. 2A is a partial plan view of the antenna device in accordance with an embodiment of the disclosure.

In the present embodiment, the structure of the second radiating element 14 is different from that of the first radiating element 13 (refer to FIG. 2A). In practice, any radiating elements that produce different radiation patterns are utilized. Furthermore, in an embodiment, the first switching element 16 and the second switching element 18 are simultaneously controlled by the control unit 19 to obtain different resonance modes at the same frequency according to the environment requirements in the antenna device 1, and then obtain different radiation patterns. The structure, function and connection relationship of the components included in the antenna device 1 will be described in detail below.

Please refer to FIG. 2A. FIG. 2A is a partial plan view of the antenna device in accordance with an embodiment of the disclosure. As shown in FIG. 2A, in an embodiment, the antenna device 1 includes a base board (substrate) 10, a ground layer 11, a feeding element 12, a first radiating element 13, a second radiating element 14, a first switching element 16, a second switching element 18, a control unit 19 and a signal source 20. In an embodiment, the ground layer 11, the feeding element 12, the first radiating element 13, the second radiating element 14, and the control unit 19 of the antenna device 1 are disposed on a surface 102 of a base board 10, which is not limited herein. In other embodiments, the ground layer 11, the feeding element 12, the first radiating element 13, and the second radiating element 14 of the antenna device 1 are disposed on the surface 102 of the base board 10, and the control unit 19 is disposed on another surface opposite to the surface 102 of the base board 10 and is electrically connected to the feeding element through a guide hole (not shown) on the base board 10. In the present embodiment, the ground layer 11, the feeding element 12, the first radiating element 13, and the second radiating element 14 are coplanar.

In FIG. 2A, at least one portion of the ground layer 11 surrounds the feeding element 12, the first radiating element 13, and the second radiating element 14. Furthermore, the ground layer 11 surrounds and forms an accommodating space 112 and has an opening 114. The accommodating space 112 is exposed from the ground layer 11 through the opening 114. The feeding element 12, the first radiating element 13 and the second radiating element 14 are located in the accommodating space 112 and are exposed from the ground layer 11 through the opening 114.

The feeding element 12 is connected to the ground layer 11 through the signal source 20. And, the feeding element 12 extends along a second direction D2 away from the ground layer 11, and separates the first radiating element 13 and the second radiating element 14. The feeding element 12 is connected among the signal source 20, the first switching element 16 and the second switching element 18. The feeding element 12 transmits the signal provided by the signal source 20 to the first radiating portion 130 or the second radiating element 14. For example, the feeding element 12 has a first end 120, a second end 122, and a third end 124. The first end 120 of the feeding element 12 is electrically connected to the signal source 20, the second end 122 of the feeding element 12 is electrically connected to the first radiating element 13, and the third end 124 of the feeding element 12 is electrically connected to the second radiating element.

In an embodiment, the first radiating element 13 includes a first radiating portion 130 and a coupling portion 132. The first radiating portion 130 of the first radiating element 13 is connected to the first switching element 16, and extending from the first switching element 16 to the ground layer 11 along a first direction D1 and is separated from the ground layer 11. In some embodiments, the first direction D1 intersects the second direction D2. In the present embodiment, the first direction D1 is substantially orthogonal to the second direction D2, which is not limited herein. The coupling portion 132 of the first radiating element 13 extends along the first direction D1 and connects with the ground layer 11. That is, the first radiating portion 130 of the first radiating element 13 and the coupling portion 132 are parallel to each other, which is not limited herein.

In FIG. 2A, a distance T1 exists between the coupling portion 132 of the first radiating element 13 and the first radiating portion 130 in the second direction D2. In the first direction D1, the coupling portion 132 of the first radiating element 13 is at a distance T2 from the feeding element 12, a distance T3 exists between the first radiating portion 130 of the first radiating element 13 and the feeding element 12. And, the distance T2 is greater than the distance T3. In detail, the first radiating portion 130 of the first radiating element 13 includes a first edge 130*a* facing the coupling portion 132. The coupling portion 132 includes a second edge 132*a* facing the first radiating portion 130. In the present embodiment, the contour of the first edge 130*a* of the first radiating portion 130 is complementary to the contour of the second edge 132*a* of the coupling portion 132.

Due to the spatially offset configuration of the coupling portion 132 and the first radiating portion 130 in the first radiating element 13, the space occupied by the first radiating element 13 in the antenna device 1 is reduced. For example, the first radiating portion 130 of the first radiating element 13 includes a first overlapping segment 130*c*. The coupling portion 132 of the first radiating element 13 includes a second overlapping segment 132*b*. The first overlapping segment 130*c* is separated from the second overlapping segment 132*b* by a spacing (such as distance T1). Furthermore, in the first direction D1, the distance T2 between the coupling portion 132 of the first radiating element 13 and the feeding element 12 is less than the distance T2 between an end portion 130*b* of the first radiating portion 130 and the feeding element 12. Therefore, the projection images of the first overlapping segment 130*c* of the first radiating portion 130 and the second overlapping segment 132*b* of the coupling portion 132 in the second direction D2 overlap with each other. Therefore, the space occupied by the first radiating element 13 in the first direction D1 of the antenna device 1 is reduced, the volume of the antenna device 1 is reduced subsequently, and the space utilizing of the antenna device 1 is improved.

In the embodiment, the second radiating element 14 is a T-shape. Specifically, the second radiating element 14 includes a second radiating portion 140 and a shorting portion 142 connected with each other. The second radiating portion 140 of the second radiating element 14 is connected to the second switching element 18 that extending from the second switching element 18 along the first direction D1 and is separated from the ground layer 11. The shorting portion 142 of the second radiating element 14 extends from the second radiating portion 140 to the ground layer 11 substantially along the second direction D2 orthogonal to the first direction D1.

In an embodiment, the control unit 19 is electrically connected to the feeding element 12, and is configured to switch the first switching element 16 and the second switching element 18 to an on state or an off state. The first switching element 16 is coupled between the feeding element 12 and the first radiating element 13, and configured to electrically connect or disconnect the feeding element 12 and the first radiating element 13 according to a control signal generated by the control unit 19. In an embodiment, the first switching element 16 includes a first end 160 and a second end 162. The first end of the first switching element 16 is electrically connected to the feeding element 12, and the second end 162 is electrically connected to the first radiating element 13. The first switching element 16 determines whether to conduct the first end 160 and the second end 162 according to the control signal.

The second switching element 18 is coupled between the feeding element 12 and the second radiating element 14, and is configured to electrically connect or disconnect the feeding element 12 and the second radiating element 14 according to a control signal generated by the control unit 19. That is, the current flow direction is adjusted by selectively conducting the first radiating element 13 or the second radiating element 14 according to a control signal. For example, the second switching element 18 includes a first end 180 and a second end 182. The first end 180 of the second switching element 18 is electrically connected to the feeding element 12, and the second end 182 is electrically connected to the second radiating element 14. The second switching element 18 determines whether to conduct the first end 180 and the second end 182 according to the control signal. In some embodiments, the first switching element 16 and/or the second switching element 18 is a diode, an electric transistor or any suitable electronic switch.

In one embodiment, the control unit 19 applies a voltage (such as a control signal) to the first switching element 16 and the second switching element 18 to set the first switching element 16 and the second switching element 18 to be an on state or an off state respectively. In this embodiment, an operating process of the antenna device 1 includes a first operating state S1 and a second operating state S2. In detail, when the first switching element 16 connects the feeding element 12 and the first radiating element 13, and the second switching element 18 disconnects the feeding element 12 from the second radiating element 14, the antenna device 1 operates in the first operating state S1. In the first operating state S1, the antenna device 1 generates a first radiation mode M1 at a frequency by the first radiating element 13 to obtain a first radiation pattern R1, and have a first radiation direction. In other words, in the first operating state S1, the first switching element 16 transmits the signal generated by the feeding element 12 to the first radiating element 13. At this time, the signal generated by the feeding element 12 is electromagnetically coupled to the coupling portion 132 via the distance T1, thereby causing the first radiating element 13 to generate the first resonance mode M1, and obtaining the first radiation pattern R1.

In contrast, when the first switching element 16 disconnects the feeding element 12 from the first radiating element 13, and the second switching element 18 connects the feeding element 12 and the second radiating element 14, the antenna device 1 operates in the second operating state S2. The antenna device 1 generates a second resonance mode M2 different from the first resonance mode M1 by the second radiating element 14 at the same frequency of the first operating state S1, and has a second radiation direction different from the first radiation direction. In other words, in the second operating state S2, the second switching element 18 transmits a signal generated by the feeding element 12 to the second radiating element 14, causes the second radiating element 14 to generate the second resonant mode M2, thereby obtaining a second radiation pattern R2. In an embodiment, the second radiation pattern R2 has low correlation with the first radiation pattern R1 at some angles, so the effect of omnidirectional radiation pattern is achieved by switching between the second radiation pattern R2 and the first radiation pattern R1.

Figure 2B:
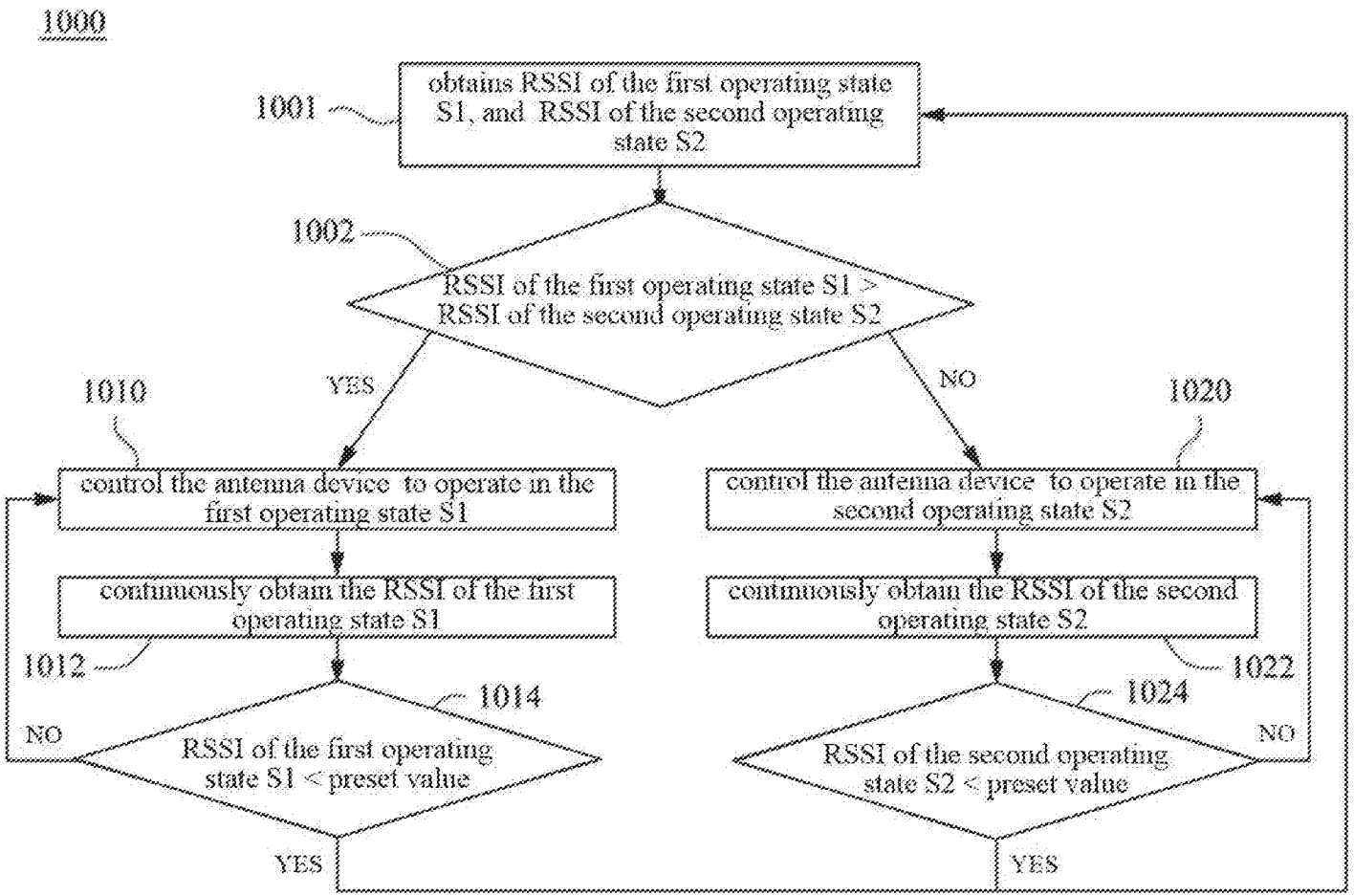
FIG. 2B is a flow chart of a control method of the antenna device of FIG. 2A.

FIG. 2B is a flow chart of a control method of the antenna device of FIG. 2A. Although the control method 1000 of this disclosure is illustrated and described as a series of steps or events, it should be understood that the illustrated order of such steps or events is not construed in a limiting sense. For example, In addition to the order shown and/or described, some steps may occur in different orders and/or concurrently with other steps or events. In addition, implementation of one or more aspects or embodiments described herein may not require all of the illustrated operations. Further, one or more of the steps depicted herein may be implemented in one or many separate steps and/or stages.

In FIG. 2B, the flowchart of the control method 1000 of the antenna device 1 includes steps 1001 to 1024, and please refer to FIG. 2A at the same time. In an embodiment, the control unit 19 of the antenna device 1 determines which the radiation pattern is suitable for the antenna device 1 currently according to the environment where the antenna device 1 is located, and the control unit 19 controls the first switching element 16 and the second switching element 18 to be an on state or an off state respectively, to adjust the suitable radiation pattern of the antenna device 1.

Specifically, in step 1001, the control unit 19 obtains a first receiving signal strength indication (RSSI) I1 when the antenna device 1 operates in the first operating state S1, and obtains a second receiving signal strength indication I2 when the antenna device 1 operates in the second operating state S2. In an embodiment, the antenna device 1 operates at the same frequency in the first operating state S and the second operating state S2.

Step 1002 is to determine the operating state. In step 1002, the control unit 19 compares the first receiving signal strength indication I1 with the second receiving signal strength indication I2. When the first receiving signal strength indication I1 of the first operating state S1 is greater than the second receiving signal strength indication I2 of the second operating state S2, step 1010 is executed. When the first receiving signal strength indication I1 of the first operating state S1 is less than the second receiving signal strength indication I2 of the second operating state S2, step 1020 is executed. When the first receiving signal strength indication I1 of the first operating state S1 is equal to the second receiving signal strength indication I2 of the second operating state S2, the current operating state is maintained. For example, the current operating state is maintained in the first operating state S1.

In step 1010, control the antenna device 1 to operate in the first operating state S1. That is, when the first receiving signal strength indication I1 is greater than the second receiving signal strength indication I2, the antenna device 1 operates in the first operating state S1. Next, in step 1012, the first receiving signal strength indication I1 of the antenna device 1 in the first operating state S1 is continuously obtained by the control unit 19. In contrast, in step 1020, control the antenna device 1 to operate in the second operating state S2. That is, when the first receiving signal strength indication I1 is less than the second receiving signal strength indication I2, the antenna device 2 operates in the second operating state S2. Next, in step 1022, the second receiving signal strength indication I2 of the antenna device 1 in the second operating state S2 is continuously obtained by the control unit 19.

Step 1014 and step 1024 are respectively to determine whether the operating state needs to be switched. While the antenna device 1 continuously operates in the first operating state S1, the first receiving signal strength indication I1 is compared with a preset value in step 1014 to determine whether the operating state needs to be switched. Similarly, while the antenna device 1 continuously operates in the second operating state S2, the second receiving signal strength indication I2 is compared with a preset value in step 1024 to determine whether the operating state needs to be switched.

Specifically, in step 1014, when the first receiving signal strength indication I1 in the first operating state S1 is less than the preset value, step 1001 and step 1002 are sequentially executed again to determine whether the first operating state S1 needs to be maintained or switched to the second operating state S2. When the first receiving signal strength indication I1 in the first operating state S1 is not less than the preset value, the antenna device 1 maintains in the first operating state S1.

Similarly, in step 1024, when the second receiving signal strength indication I2 is less than the preset value in the second operating state S2, step 1001 and step 1002 are sequentially executed again to determine whether the second operating state S2 needs to be maintained or switched to the first operating state S1. When the second receiving signal strength indication I2 in the second operating state S2 is not less than the preset value, the antenna device 1 maintains in the second operating state S2.

In an embodiment, at least two radiating elements with different structures designed share a single feed such as the feeding element 12, and the control unit 19 controls the first switching element 16 and the second switching element 18 to switch between the different radiating elements with different structures. Therefore, the antenna device 1 generates different resonance modes at a same frequency, and further obtains the radiation pattern for the current environment. In the embodiment, the different radiation patterns generated by different resonance modes jointly complement the radiation zero of the XY plane.

Therefore, the antenna device of the disclosure switches the switching element to select the radiating elements at different positions according to the environment where the antenna device is located, to solve the pattern defects caused by the single radiation member, and to enhance the radiation intensity of the radiation patterns in particular orientations. Therefore, the weak radiation intensity of the antenna device in specific orientations is avoided, thereby improving the transmission speed of the antenna device and its practicability on the product, and avoiding problems such as disconnection.

In some embodiments, the antenna structure is also changed by changing the relative position between the feeding element 12 and the first switching element 16 or changing the relative position between the feeding element 12 and the second switching element 18 to achieve a plurality of different radiation patterns at the same frequency.

Figures 3A, 3B, 3C:
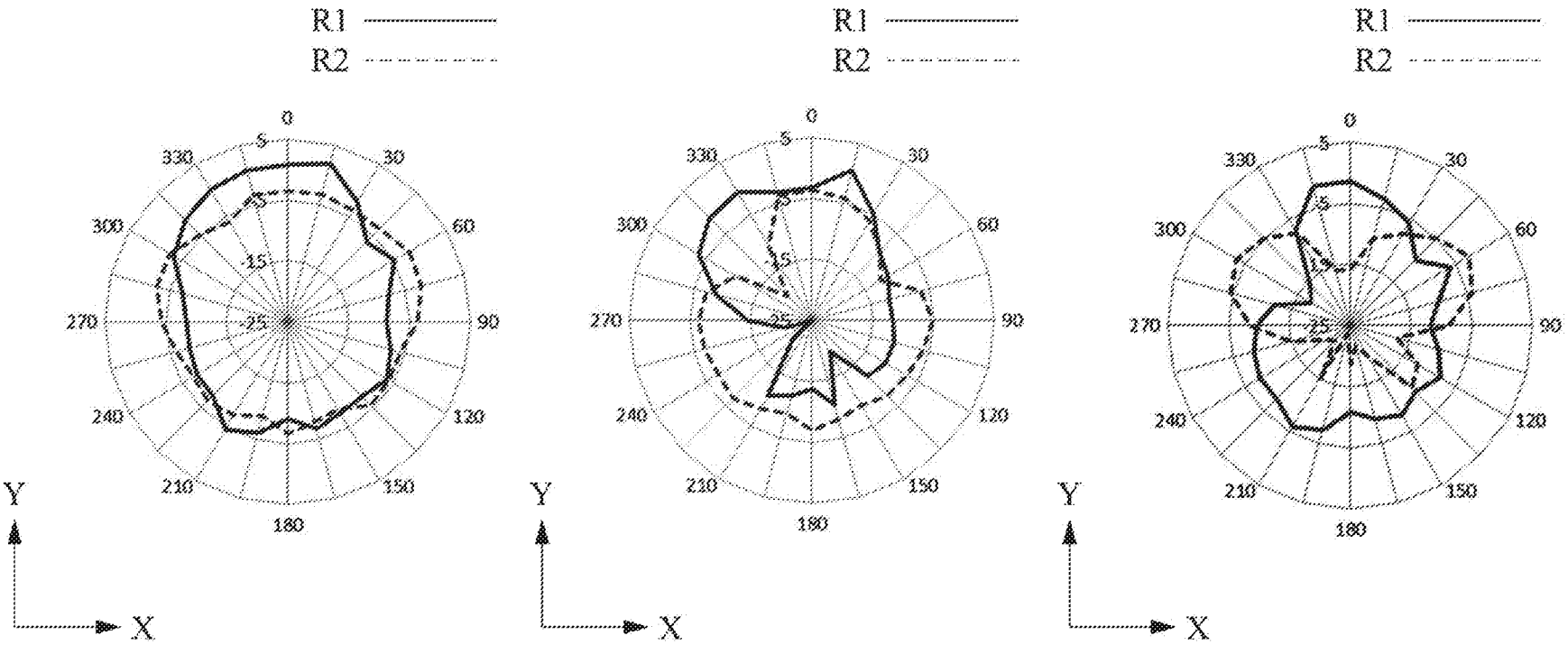
FIGS. 3A, 3B, and 3C are different radiation patterns of the antenna device according to an embodiment of the disclosure respectively.

Please refer to FIG. 2A and FIG. 3A to FIG. 3C. FIG. 3A. FIG. 3B, FIG. 3C respectively show a total radiation pattern, a horizontal polarization pattern, and a vertical polarization pattern of the antenna device 1 at a design frequency according to an embodiment of the disclosure. In the embodiment, by utilizing a single feeding element and the cooperation among the signal source 20, the first switching element 16 and the second switching element 18, the antenna device 1 generates the first radiation pattern R1 belonging to the first resonance mode M1 at a frequency by the first radiating element 13 in the first operating state S1 (as indicated by the solid line in FIG. 3A), or, the antenna device 1 generates a second radiation pattern R2 belonging to the second resonance mode M2 at the aforementioned frequency by the second radiating element 14 in the second operating state S2 (as indicated by the dashed line in FIG. 3A).

Please refer to FIG. 3A. In this embodiment, the first radiation pattern R1 of the antenna device 1 in the first operating state S1 has a weak total radiation at orientations of about 30 to about 150 degrees and about 225 to about 300 degrees, and the second radiation pattern R2 of the antenna device 1 at the second operating state S2 has a strong total radiation at orientations of about 30 to about 150 degrees and about 225 to about 300 degrees. The antenna device 1 alternately switches the switching elements to select the first radiating element 13 or the second radiating element 14 according to the needs of the environment, thus, the total radiation of the first radiation pattern R1 at orientations of about 30 to about 150 degrees and about 225 to about 300 degrees is complemented by the second radiation pattern R2 at the same frequency, which avoid the defect of the radiation patterns of the antenna device caused by a single radiating element.

Similarly, the second radiation pattern R2 of the antenna device 1 at the second operating state S2 has a weak total radiation at 0 degree and 180 degree, and the first radiation pattern R1 of the antenna device 1 at the first operating state S1 has a strong total radiation at orientations of about 0 to about 30 degrees and about 300 to about 360 degrees. The antenna device 1 switches the switching elements to select the first radiating element 13 or the second radiating element 14 according to the requirements of the environment, thus, the total radiation of the second radiation pattern R2 at orientations of about 0 to about 30 degrees and about 300 to about 360 degrees is complemented by the first radiation pattern R1 at the same frequency.

Furthermore, in FIG. 3B and FIG. 3C, the first radiation pattern R1 of the antenna device 1 at the first operating state S1 has weak horizontal polarization radiation at an orientation of about 60 to about 285 degrees, and weak vertical polarization radiation at orientations of about 30 to about 90 degrees and about 270 to about 330 degrees. In contrast, the second radiation pattern R2 of the antenna device 1 at the second operating state S2 has strong horizontal polarization radiation at an orientation of about 60 to about 285 degrees and about 30 to about 90 degrees, and strong vertical polarization field radiation at an orientation of about 270 to about 330 degrees.

Similarly, the second radiation pattern R2 of the antenna device 1 at the second operating state S2 has weak horizontal polarization radiation at an orientation of about 0 to about 60 degrees and about 285 to about 360 degrees, and has weak vertical polarization radiation at an orientation of about 0 to about 30 degrees, about 330 to about 360 degrees, and about 90 to about 270 degrees. In contrast, the first radiation pattern R1 of the antenna device 1 at the first operating state S1 has strong horizontal polarization radiation at an orientation of about 0 to about 60 degrees and about 285 to about 360 degrees, and has strong vertical polarization radiation at an orientation of about 0 to about 30 degrees, about 330 to about 360 degrees, and about 90 to about 270 degrees. Therefore, the first radiation pattern R1 and the second radiation pattern R2 at the same frequency are complementary to each other by switching the switching elements to select the first radiating element 13 and the second radiating element 14 with different structures and different positions.

The antenna device 1 of the disclosure switches the switching elements to select between the first radiating element 13 and the second radiating element 14 with different positions and different structures according to the requirements of the environment to generate the first radiation pattern R1 and the second radiation pattern R2 at the same frequency to complement each other's radiation pattern defects, thereby avoiding the problem that the antenna device 1 has a weak signal in a specific orientation.

Figure 4A:
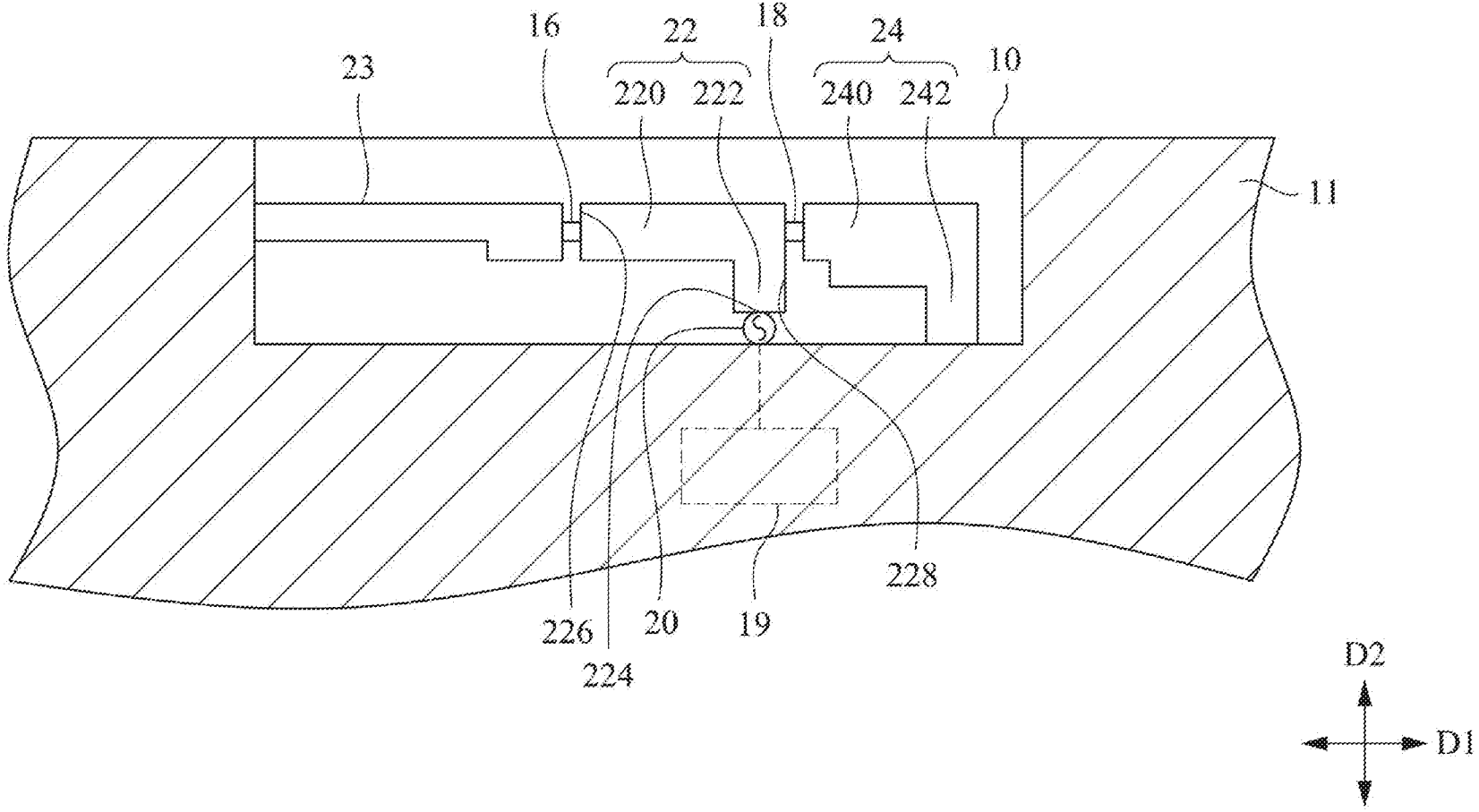
FIG. 4A is a partial plan view of an antenna device in accordance with another embodiment of the disclosure.

FIG. 4A is a partial plan view of an antenna device in accordance with another embodiment of the disclosure. As shown in FIG. 4A, in the embodiment, the antenna device 2 includes a base board 10, a ground layer 11, a feeding element 22, a first radiating element 23, a second radiating element 24, a first switching element 16, a second switching element 18, a control unit 19, and a signal source 20. The structure and function of these components and the connection relationship between the components of the antenna device 2 are substantially the same as those of the antenna device 1 shown in FIG. 2A. Therefore, reference may be made to the related descriptions above mentioned, and details are not described herein again. In an embodiment, the feeding element 22 includes a third radiating portion 220 and a feeding portion 222 connecting with each other. The feeding portion 222 of the feeding element 22 is connected to the ground layer 11 via the signal source 20 and extends away from the ground layer 11 along a second direction D2. The feeding element 22 separates the first radiating element 23 from the second radiating element 24. The third radiating portion 220 of the feeding element 22 is connected between the feeding portion 222 and the first switching element 16, and extending substantially along the first direction D1. The feeding portion 222 of the feeding element 22 is connected among the signal source 20, the third radiating portion 220 and the second switching element 18. Furthermore, the third radiating portion 220 of the feeding element 22 is connected between the feeding portion 222 and the first switching element 16. The feeding portion 222 of the feeding element 22 transmits a signal provided by the signal source 20 to the third radiating portion 220, the first radiating element 23, or the second radiating element 24.

In one embodiment, the feeding element 22 has a first end 224, a second end 226, and a third end 228. The first end 224 of the feeding element 22 is electrically connected to the signal source 20, the second end 226 of the feeding element 22 is electrically connected to the first radiating element 23, and the third end 228 of the feeding element 22 is electrically connected to the second radiating element 24.

In the present embodiment, the first radiating element 23 is connected between the first switching element 16 and the ground layer 11, and extending from the first switching element 16 to the ground layer 11 along the first direction D1. In this embodiment, the shape of the second radiating element 24 is L-shaped. Specifically, the second radiating element 24 includes a second radiating portion 240 and a shorting portion 242 connecting with each other. The second radiating portion 240 of the second radiating element 24 is connected to the second switching element 18, and extending from the second switching element 18 to the shorting portion 242 along the first direction D1. The shorting portion 242 of the second radiating element 24 extends from the second radiating portion 240 to the ground layer 11 along the second direction D2. In the present embodiment, the structure of the second radiating element 24 is different from the structure of the first radiating element 23.

In one embodiment, the control unit 19 applies a voltage (such as a control signal) to the first switching element 16 and the second switching element 18 to respectively switch the first switching element 16 and the second switching element 18 to be on state or off state. In this embodiment, an operating process of the antenna device 2 includes a first operating state S1', a second operating state S2', and a third operating state S3. In detail, when the first switching element 16 conducts between the feeding element 22 and the first radiating element 23, and the second switching element 18 disconnects the feeding element 22 from the second radiating element 24, the antenna device 2 operates in the first operating state S1'. When the antenna device 2 operates in the first operating state S1', the antenna device 2 generates a first radiation pattern M1' at a frequency by the first radiating element 23 and the radiation portion 220 of the feeding element 22 to obtain a first radiation pattern R1', and has a first radiation direction.

In contrast, when the first switching element 16 disconnects the feeding element 22 from the first radiating element 23, and the second switching element 18 conducts between the feeding element 22 and the second radiating element 24, the antenna device 2 operates in the second operating state S2'. In the second operating state S2', the antenna device 2 generates a second resonance mode M2' different from the first resonance mode M1' by the second radiating element 24 at the same frequency of the first operating state S1', and has a second radiation direction different from the first radiation direction described. In other words, in the second operating state S2', the second switching element 18 transmits a signal generated by the feeding element 22 to the second radiating element 24, causes the second radiating element 24 to generate a second resonant mode M2', and then obtains the second radiation pattern R2.

In contrast, when the first switching element 16 disconnects the feeding element 22 from the first radiating element 23, and the second switching element 18 disconnects the feeding element 22 from the second radiating element 24, the antenna device 2 operates in the third operating state S3. The antenna device 2 generates a third resonance mode M3 different from the first resonance modes M1' and the second resonance mode M2' and has a third radiation direction different from the first and second radiation directions through the radiating portion 220 of the feeding element 22 at the same frequency of the first operating state S1' and the second operating state S2'. In other words, in the third operating state S3, the feeding portion 222 of the feeding element 22 directly transmits the signal generated by the signal source 20 to the radiating portion 220 of the feeding element 22, causes the radiating portion 220 to generate the third resonance mode M3, and then obtains the third radiation pattern R3. In an embodiment, the first radiation pattern R1', the second radiation pattern R2', and the third radiation pattern R3 are complementary to each other.

Figure 4B:
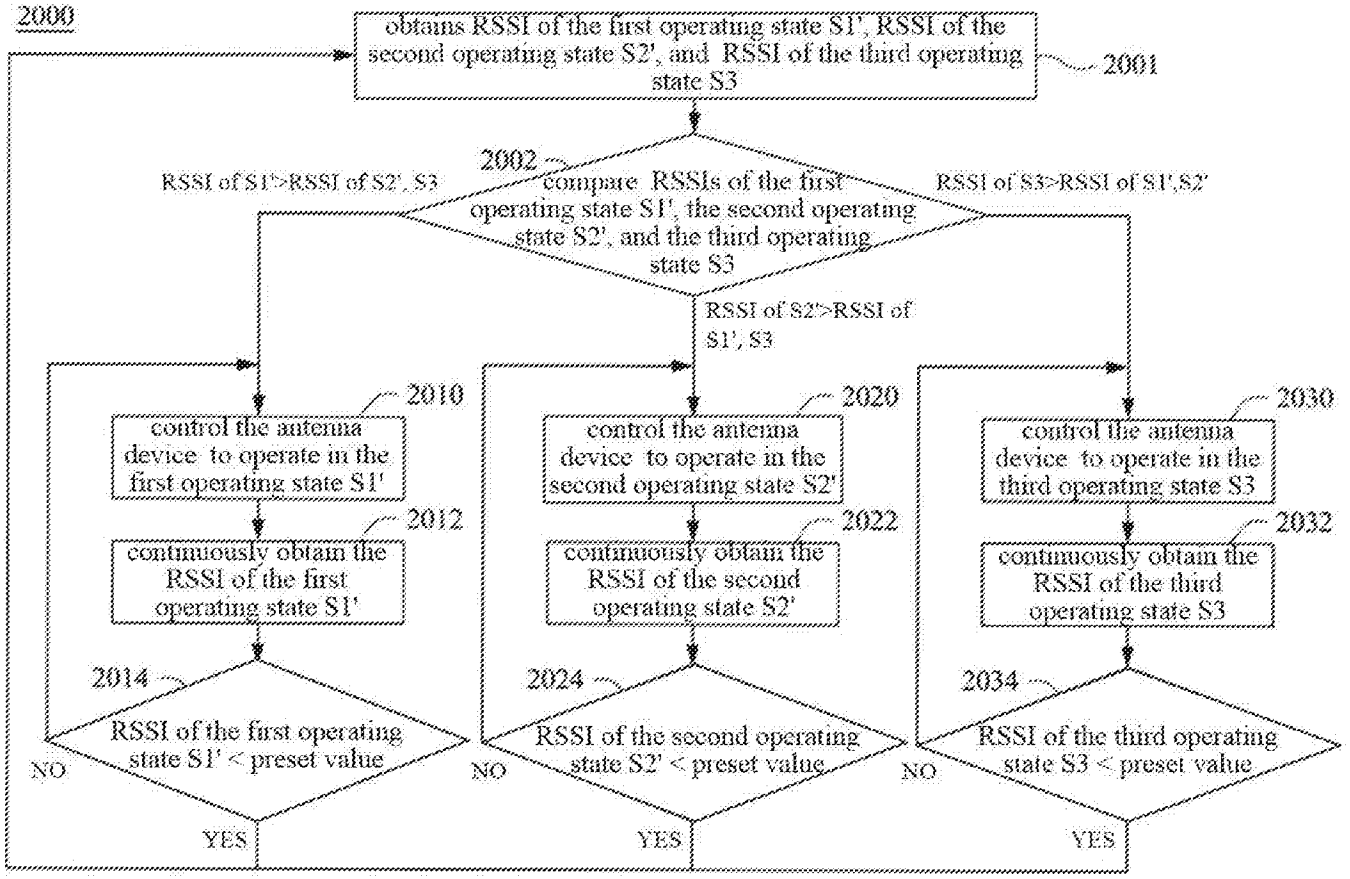
FIG. 4B is a flow chart of a control method of the antenna device of FIG. 4A.

FIG. 4B is a flow chart of a control method of the antenna device of FIG. 4A. Although the disclosed control method 2000 is illustrated and described as a series of steps or events, it should be understood that the illustrated order of such steps or events is not construed in a limiting sense. For example, In addition to the order shown and/or described, some steps may occur in different orders and/or concurrently with other steps or events. In addition, implementation of one or more aspects or embodiments described herein may not require all of the illustrated operations. Further, one or more of the steps depicted herein may be implemented in one or many separate steps and/or stages.

In FIG. 4B, the flowchart of the control method 2000 of the antenna device 2 includes steps 2001 to 2034, and please refer to FIG. 4A also. In an embodiment, the control unit 19 of the antenna device 2 determines the radiation pattern that suitable for the antenna device 2 according to the environment where the antenna device 2 is located. The first switching element 16 and the second switching element 18 are switched to appropriate radiation pattern for the antenna device 2.

Specifically, in step 2001, the control unit 19 obtains a first receiving signal strength indication I1' of the antenna device 2 in the first operating state S1', obtains a second receiving signal strength indication I2' of the antenna device 2 in the second operating state S2', and obtains a third receiving signal strength indication 13 of the antenna device 2 in the third operating state S3. In the present embodiment, the antenna device 2 operates at the same frequency in the first operating state S1', the second operating state S2', and the third operating state S3.

Step 2002 is a determination step to select an operating state. In step 2002, the control unit 19 compares the first receiving signal strength indication I1', the second receiving signal strength indication I2', and the third receiving signal strength indication I3 with each other.

For example, when the first receiving signal strength indication I1' is greater than the second receiving signal strength indication I2' and the third receiving signal strength indication I3, step 2010 is executed. In step 2010, control the antenna device 2 to operate in the first operating state S1'. Next, in step 2012, the first receiving signal strength indication I1' of the antenna device 2 in the first operating state S1' is continuously obtained by the control unit 19. Then, step 2014 is a determination step of switching the operating state. In step 2014, the first receiving signal strength indication I1' is compared with a preset value periodically to determine whether to switch the operating state while the antenna device 2 maintains operating in the first operating state S1'. Specifically, in step 2014, when the first receiving signal strength indication I1' in the first operating state S1' is less than the preset value, the step 2001 and step 2002 are sequentially executed again to determine whether to the first operating state S1' needs to be maintained or switched to the second operating state S2' or the third operating state S3. When the first receiving signal strength indication I1' in the first operating state S1' is not less than the preset value, then the antenna device 2 maintains in the first operating state S1'.

In an embodiments, when the second receiving signal strength indication I2' is greater than the first receiving signal strength indication I1' and the third receiving signal strength indication I3, step 2020 is executed. In step 2020, the antenna device 2 is controlled to operate in the second operating state S2'. Next, in step 2022, the control unit 19 continuously obtains the second receiving signal strength indication I2' of the antenna device 2 in the second operating state S2'. Then, step 2024 is a determination step of switching the operating state. While the antenna device 2 is continuously operating in the second operating state S2', compare the second receiving signal strength indication I2' with a preset value periodically in step 2024 to determine whether the operating state needs to be switched. Specifically, in step 2024, when the second receiving signal strength indication I2' in the second operating state S2' is less than the preset value, step 2001 and step 2002 are sequentially executed to determine whether the second operating state S2' needs to be maintained or switched to the first operating state S1' or the third operating state S3. When the second receiving signal strength indication I2' in the second operating state S2' is not less than the preset value, the antenna device 2 maintains in the second operating state S2'.

In some embodiments, when the third receiving signal strength indication I3 is greater than the first receiving signal strength indication I1' and the second receiving signal strength indication I2', step 2030 is executed. In step 2030, the antenna device 2 is controlled to operate in the third operating state S3. Next, in step 2032, the third receiving signal strength indication I3 of the antenna device 2 in the third operating state S3 is continuously obtained by the control unit 19. Then, step 2034 is a determination step of switching the operating state. While the antenna device 2 is continuously operating in the third operating state S3, the third receiving signal strength indication I3 is periodically compared with a preset value in step 2034 to determine whether the operating state needs to be switched. Specifically, in step 2034, when the third receiving signal strength indication I3 in the third operating state S3 is less than the preset value, step 2001 and step 2002 are sequentially executed again to determine whether the third operating state S3 needs to be maintained or switched to the first operating state S1' or the second operating state S2'. When the third receiving signal strength indication I3 in the third operating state S3 is not less than the preset value, the antenna device 2 maintains in the third operating state S3.

Figures 5A, 5B, 5C:
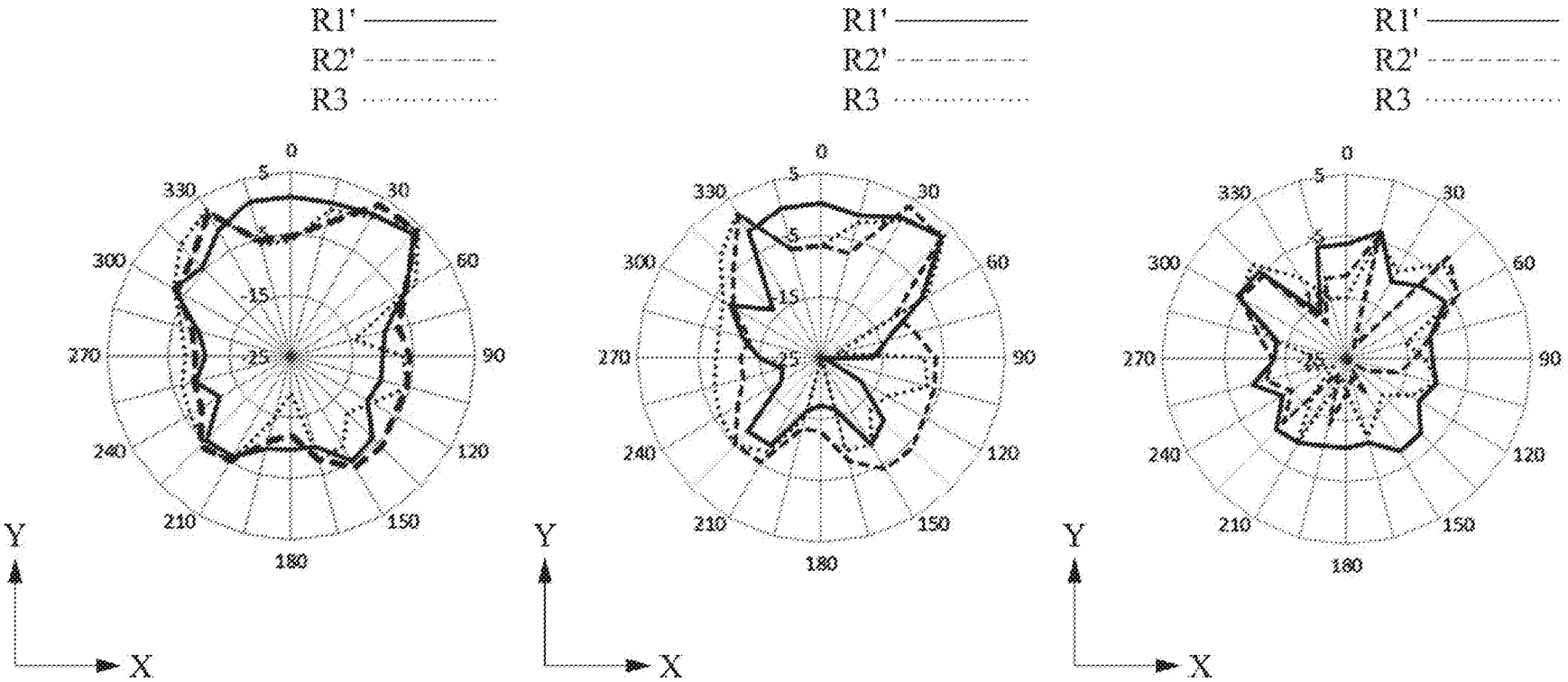
FIGS. 5A, 5B, and 5C are different radiation patterns of the antenna device according to another embodiment of the disclosure respectively.

Please refer to FIG. 4A and FIG. 5A to FIG. 5C. FIG. 5A, FIG. 5B, FIG. 5C respectively illustrate a total radiation pattern, a horizontal polarization pattern, and a vertical polarization pattern of the antenna device 2 according to another embodiment of the disclosure at a design frequency. As shown in FIG. 5A, in the embodiment, by utilizing a single feeding element and the cooperation among the signal source 20, the first switching element 16 and the second switching element 18, the antenna device 2 generates the first radiation pattern R1' belonging to the first resonance mode M1' at a frequency by the first radiating element 23 and the third radiating portion 220 of the feeding element 22 in the first operating state S1' (as shown by the solid line in FIG. 5A). Or, the antenna device 2 generates a second radiation pattern R2' belonging to the second resonance mode M2' at the aforementioned frequency by the second radiating element 14 in the second operating state S2' (as indicated by the dashed line in FIG. 5A). Or, the antenna device 2 generates a third radiation pattern R3 of the third resonance mode M3 at the aforementioned frequency by the third radiating portion 220 of the feeding element 22 in the third operating state S3 (as shown by the dotted line in FIG. 5A).

In the present embodiment, the first switching element 16 and the second switching element 18 are controlled by the control unit 19 and switch between the radiating elements with different structures. The antenna device 2 generates the first resonance mode M1', the second resonance mode M2', and the third resonance mode at the same frequency according to environmental requirements, and then obtains the first radiation pattern R1', the second radiation pattern R2', and third radiation pattern R3. Therefore, there are at least three antennas with different structures and the same feed element (such as the feeding element 22). In addition, at least three different radiation patterns at the same frequency are generated by utilizing the cooperation among the signal source 20, the first switching element 16 and the second switching element 18. At the same time, the antenna device 2 switches the switching element to select radiating elements with different positions and different structures according to the requirements of the environment, so as to generate the first radiation pattern R1', the second radiation pattern R2' or the third radiation pattern R3 at the same frequency to complement radiation pattern defects of each other, thereby avoiding the problem that the signal of the antenna device 2 is weak in a particular orientation.

Figure 6A:
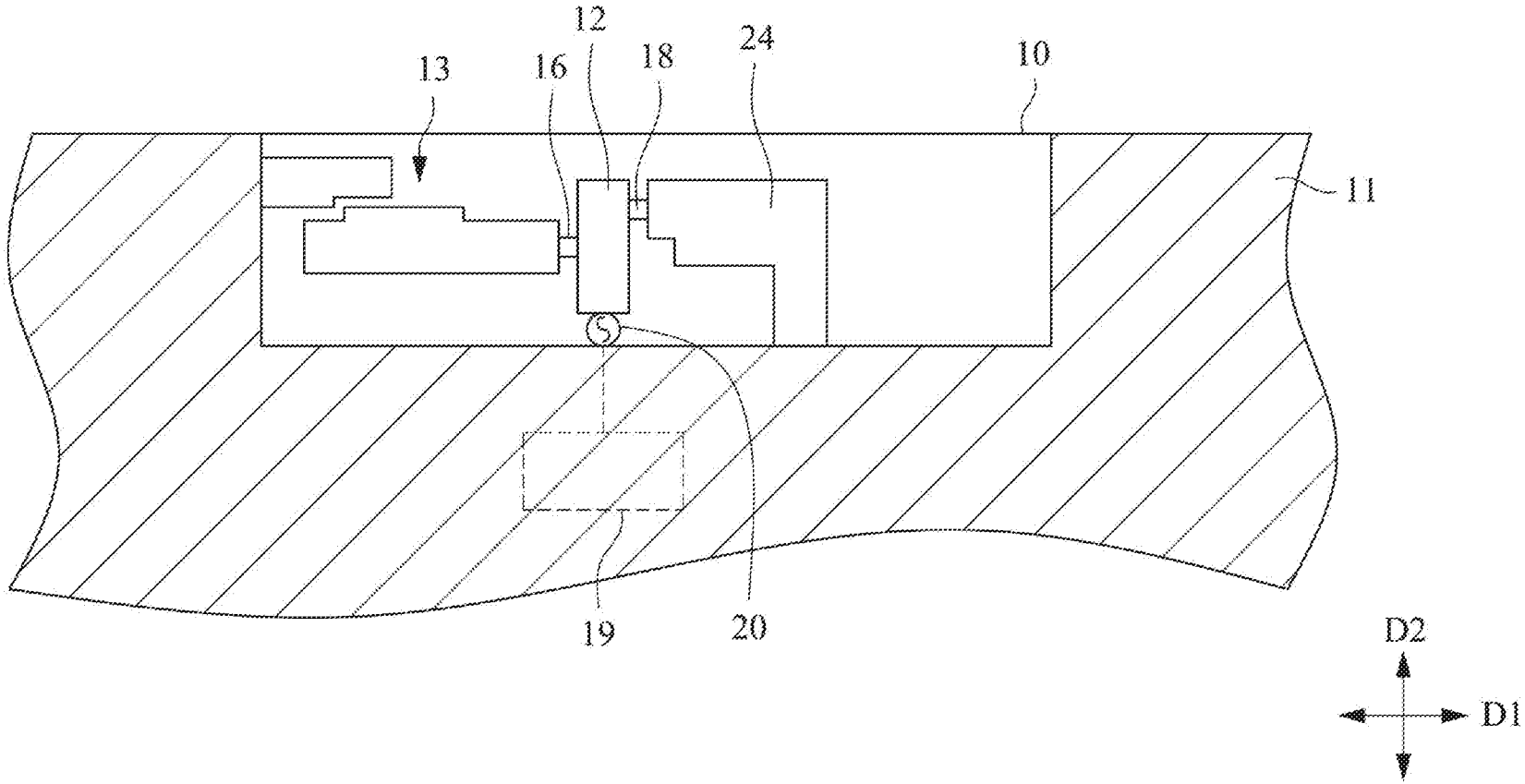
FIGS. 6A, 6B, and 6C are partial top views of the antenna device according to further another embodiment of the disclosure.

FIG. 6A is a partial top view of the antenna device 3 according to another embodiment of the present invention. As shown in FIG. 6A, in an embodiment, the antenna device 3 includes a base board 10, a ground layer 11, a feeding element 12, a first radiating element 13, a second radiating element 24, a first switching element 16, a second switching element 18, a control unit 19, and a signal source 20. The structure and function of these components and the connection relationship between the components of the antenna device 3 are substantially the same as those of the antenna device 1 shown in FIG. 2A. Therefore, reference may be made to the related descriptions above mentioned, and details are not described herein again.

In an embodiment, the structure of the first radiating element 13 is different from the structure of the second radiating element 24, and at least two antennas with different structures are designed by a single feeding method (for example, utilizing the feeding element 12), and at least two different radiation patterns at the same frequency is generated by utilizing the cooperation among the signal source 20, the first switching element 16 and the second switching element 18 according to the environment where the antenna device 3 is located, to complement each other's radiation pattern defects, thereby avoiding the problem that the signal of the antenna device 2 is weak in a particular orientation.

Figure 6B:
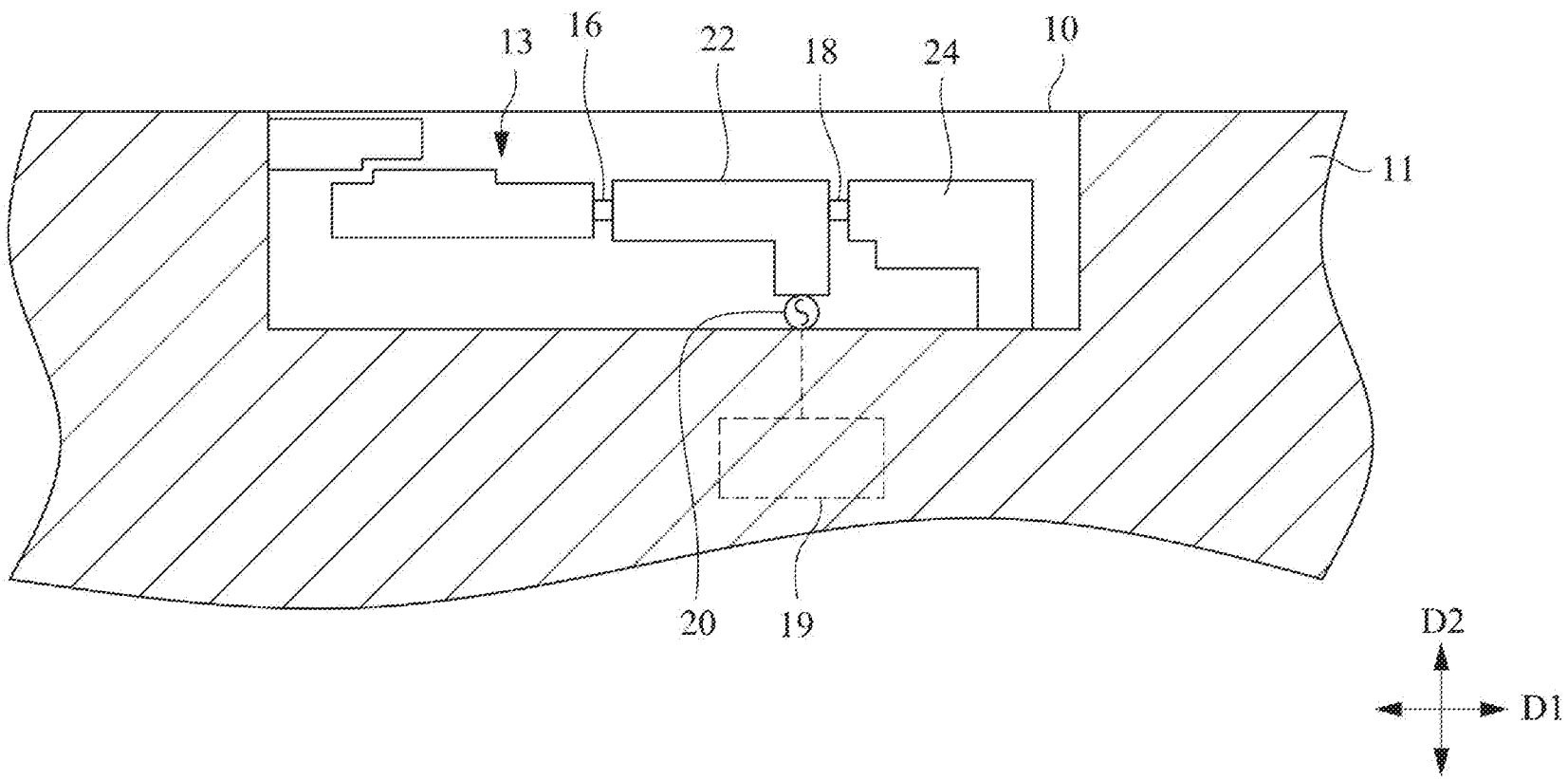

FIG. 6B is a partial top view of the antenna device 4 according to another embodiment of the disclosure. As shown in FIG. 6B, the antenna device 3 includes a base board 10, a ground layer 11, a feeding element 22, a first radiating element 13, a second radiating element 24, a first switching element 16, a second switching element 18, a control unit 19 and a signal source 20. The structure and function of these components and the connection relationship between the components of the antenna device 3 are substantially the same as those of the antenna device 2 shown in FIG. 4A. Therefore, reference may be made to the related descriptions above mentioned, and details are not described herein again.

In an embodiment, the structure of the first radiating element 13 is different from the structure of the second radiating element 24, and at least three antennas with different structures are designed by a single feeding method (for example, by the feeding element 22), and at least three different radiation patterns at the same frequency are generate by utilizing the cooperation among the signal source 20, the first switching element 16 and the second switching element 18 according to the environment where the antenna device 4 is located, to complement each other's radiation pattern defects, thereby avoiding the problem that the antenna device 4 has a weak signal in a specific orientation.

Figure 6C:
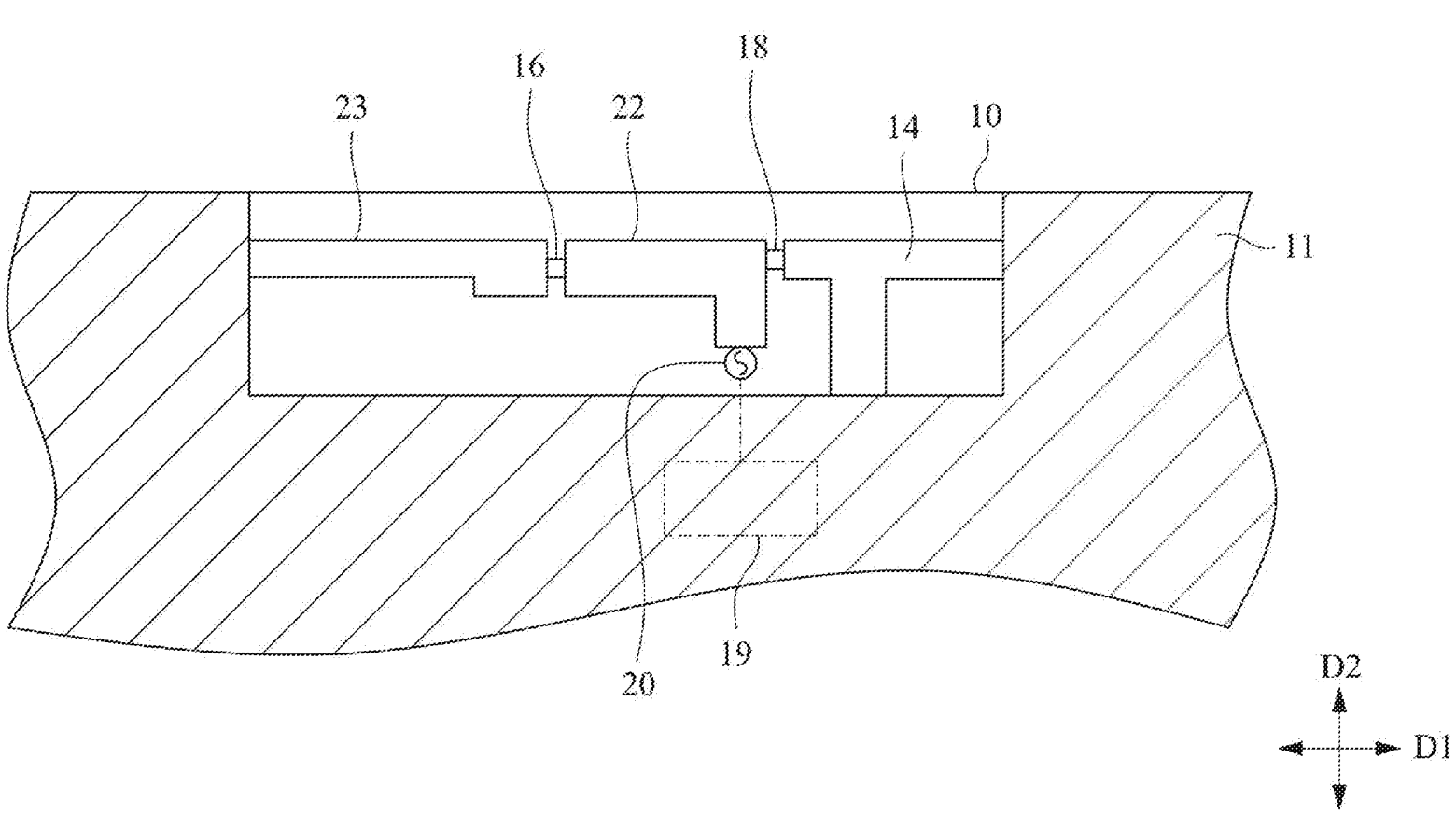

FIG. 6C is a partial plan view of an antenna device 5 according to another embodiment of the disclosure. As shown in FIG. 6C, the antenna device 3 includes a base board 10, a ground layer 11, and a feeding element 22, a first radiating element 23, a second radiating element 14, a first switching element 16, a second switching element 18, a control unit 19, and a signal source 20. The structure, function, and connection relationship between the components of the antenna device 3 are substantially the same as the antenna device 2 shown in FIG. 4A, so reference may be made to the foregoing related description above mentioned, and details are not described herein again.

In the present embodiment, the structure of the first radiating element 23 is different from the structure of the second radiating element 14, at least three antennas of different structures are designed by a single feeding method (for example, by the feeding element 22), and at least three different radiation patterns at the same frequency are generated by utilizing the cooperation among the signal source 20, the first switching element 16 and the second switching element 18 according to the environment where the antenna device 5 is located, to complement each other's radiation pattern defects, thereby avoiding the problem that the antenna device 4 has a weak signal in a specific orientation.

Under the foregoing structural configuration, at least two antennas of different structures designed by a single feeding method in the embodiment of the disclosure, the first switching element and the second switching element are controlled by the control unit. At the same time, different resonance modes at the same frequency are generated by utilizing the cooperation among the signal source, the first switching element and the second switching element 18, and different radiation patterns are further obtained. In the embodiment, the different radiation patterns generated jointly complement the radiation zero of the XY plane with each other. That is, in the antenna device, different radiation patterns complement each other to solve the problem that the radiation intensity of the antenna device is weak in particular orientations by the resonance modes different from each other, thereby avoiding the zero point of the radiation patterns of the antenna device.

Therefore, the antenna device of the disclosure switches the switching element to select the radiating elements at different positions according to the environment where the antenna device is located, to solve the pattern defects caused by the single radiation member, and to enhance the radiation intensity of the radiation patterns in particular orientations. Therefore, the problem that the radiation intensity of the antenna device is weak in a specific orientations is avoided, thereby improving the transmission speed of the antenna device and its practicability on the product, and avoiding problems such as disconnection.

Although the disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An antenna device, comprising:

a ground layer;

a feeding element, connecting to the ground layer;

a first radiating element, extending along a first direction and connected to the ground layer;

a second radiating element, extending along a second direction which is orthogonal to the first direction, and connecting the ground layer;

a first switching element, coupling between the feeding element and the first radiating element, and configured to electrically connect or disconnect the feeding element and the first radiating element; and a second switching element disposed between the feeding element and the second radiating element, and configured to electrically connect or disconnect the feeding element and the second radiating element, wherein the second radiating element comprises a second radiating portion and a shorting portion connected with each other, the second radiating portion extends away from the second switching element along the first direction, and the shorting portion extends from the second radiating portion to the ground layer along the second direction, and the feeding element includes a third radiating portion and a feeding portion connected with each other, the third radiating portion is connected to the first switching element, and the feeding portion is connected to the second switching element.

2. The antenna device according to claim 1, further comprising a control unit, coupled to the feeding element and configured to switch the first switching element and the second switching element.

3. The antenna device according to claim 1, wherein the feeding element separates the first radiating element and the second radiating element.

4. The antenna device according to claim 1, further comprising a signal source, wherein the feeding element is coupled between the signal source and the first switching element.

5. The antenna device according to claim 1, wherein the first radiating element includes a first radiating portion and a coupling portion separated with each other, the first radiating portion is coupled to the first switching element, and the coupling portion is coupled to the ground layer.

6. The antenna device according to claim 5, wherein the first radiating portion and the coupling portion extend along the first direction respectively, the first radiating portion includes a first overlapping segment, the coupling portion including a second overlapping segment, a distance exists between the first overlapping segment and the second overlapping segment, and projection images of the first overlapping segment and the second overlapping segment in the second direction overlap with each other.

7. The antenna device according to claim 6, wherein the first radiating portion includes a first edge facing the coupling portion, the coupling portion includes a second edge facing the first radiating portion, and the contour of the first edge is complementary to the contour of the second edge.

8. The antenna device according to claim 1, wherein the ground layer, the feeding element, the first radiating element, and the second radiating element are coplanar.

9. The antenna device according to claim 1, wherein at least one portion of the ground layer surrounds the feeding element, the first radiating element, and the second radiating element.

10. A control method for an antenna device, the antenna device includes a feeding element, a first radiating element, and a second radiating element, the feeding element is coupled between the first radiating element and the second radiating element, the control method comprises:

obtaining a first receiving signal strength indication of the antenna device in a first operating state, wherein the feeding element is connected with the first radiating element and disconnected from the second radiating element in the first operating state;

obtaining a second receiving signal strength indication of the antenna device in a second operating state, wherein the feeding element is disconnected from the first radiating element and is connected with the second radiating element in the second operating state, and the antenna device operates in a same frequency in both the first operating state and the second operating state;

comparing the first receiving signal strength indication with the second receiving signal strength indication, wherein the antenna device operates in the first operating state when the first receiving signal strength indication is greater than the second receiving signal strength indication, and the antenna device operates in the second operating state when the first receiving signal strength indication is not greater than the second receiving signal strength indication; and comparing the first receiving signal strength indication with a preset value when the antenna device operates in the first operating state, wherein the antenna device continuously operates in the first operating state when the first receiving signal strength indication is not less than the preset value, and the step of comparing the first receiving signal strength indication with the second receiving signal strength indication is executed again when the first receiving signal strength indication is less than the preset value.

11. The antenna device according to claim 1, wherein the second radiating element is in a T-shaped.

12. The antenna device according to claim 1, wherein the ground layer surrounds the feeding element, the first and second radiating elements, and the first and second switching elements from a top view.

13. The antenna device according to claim 5, wherein the first radiating portion of the first radiating element has opposite end segments and a middle segment between the end segments, and the middle segment of the first radiating portion has a wider width than the end segments of the first radiating portion measured in the second direction.

14. A control method for an antenna device, the antenna device includes a feeding element, a first radiating element, and a second radiating element, the feeding element is coupled between the first radiating element and the second radiating element, the control method comprises:

obtaining a first receiving signal strength indication of the antenna device in a first operating state, wherein the feeding element is connected with the first radiating element and disconnected from the second radiating element in the first operating state;

obtaining a second receiving signal strength indication of the antenna device in a second operating state, wherein the feeding element is disconnected from the first radiating element and is connected with the second radiating element in the second operating state, and the antenna device operates in a same frequency in both the first operating state and the second operating state;

obtaining a third receiving signal strength indication of the antenna device in a third operating state, wherein the feeding element is disconnected from the first radiating element and disconnected from the second radiating element in the third operating state; and comparing the first receiving signal strength indication, the second receiving signal strength indication, and the third receiving signal strength indication, wherein the antenna device operates in the first operating state when the first receiving signal strength indication is greater than the second receiving signal strength indication and the third receiving signal strength indication, the antenna device operates in the second operating state when the second receiving signal strength indication is greater than the first receiving signal strength indication and the third receiving signal strength indication, and the antenna device operates in the third operating state when the third receiving signal strength indication is greater than the first receiving signal strength indication and the second receiving signal strength indication.

15. The control method of the antenna device according to claim 14, wherein the antenna device operates at the same frequency in the first operating state, the second operating state, and the third operating state.

16. The control method of the antenna device according to claim 14, further comprising:

comparing the third receiving signal strength indication with a preset value when the antenna device operates in the third operating state, wherein the antenna device continuously operates in the third operating state when the third receiving signal strength indication is not less than the preset value, and the step of comparing the first receiving signal strength indication, the second receiving signal strength indication and the third receiving signal strength indication is executed again when the third receiving signal strength indication is less than the preset value.

* * * * *